US010234812B2

(12) United States Patent
Shima et al.

(10) Patent No.: US 10,234,812 B2
(45) Date of Patent: Mar. 19, 2019

(54) TRANSPORT MEMBER AND DEVELOPING DEVICE INCLUDING THE SAME

(71) Applicant: Konica Minolta, Inc., Chiyoda-ku, Tokyo (JP)

(72) Inventors: Toshiaki Shima, Sanda (JP); Yohei Ito, Toyokawa (JP); Kazuyoshi Ota, Chiryu (JP); Hiroaki Umemoto, Neyagawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/730,304

(22) Filed: Oct. 11, 2017

(65) Prior Publication Data

US 2018/0120752 A1 May 3, 2018

(30) Foreign Application Priority Data

Oct. 28, 2016 (JP) ..... 2016-211299

(51) Int. Cl.
*G03G 15/00* (2006.01)
*G03G 15/08* (2006.01)

(52) U.S. Cl.
CPC ..... *G03G 15/751* (2013.01); *G03G 15/0891* (2013.01); *G03G 15/0893* (2013.01); *G03G 15/757* (2013.01); *G03G 2221/1606* (2013.01)

(58) Field of Classification Search
CPC ..... G03G 15/0891; G03G 2215/0827; G03G 15/0893
See application file for complete search history.

(56) References Cited

U.S. PATENT DOCUMENTS

2013/0078003 A1* 3/2013 Stelter ..... G03G 15/0893 399/254
2017/0212451 A1* 7/2017 Van de Straete .. G03G 15/0891

FOREIGN PATENT DOCUMENTS

JP 2005-352042 A 12/2005
JP 2016-99378 A 5/2016

* cited by examiner

*Primary Examiner* — Sevan A Aydin
(74) *Attorney, Agent, or Firm* — Buchanan Ingersoll & Rooney PC

(57) ABSTRACT

A transport member, that transports a developer by rotating in a rotation direction that is predetermined around a rotation axis, includes: a shaft part including the rotation axis; and a blade part spirally provided on an outer peripheral surface of the shaft part, wherein the blade part includes a transport surface that is a surface facing a downstream side in a transport direction of the developer along the rotation axis, and a non-transport surface that is a surface other than the transport surface, and the transport member further includes a fin protruding from the non-transport surface of the blade part, the fin being provided with an interval from the outer peripheral surface of the shaft part.

13 Claims, 10 Drawing Sheets

FIG. 7

| SAMPLE | NAME | TOTAL | VZ | VR | Vθ |
|---|---|---|---|---|---|
| 1 | NORMAL Sc | △ | 7.8 | 0.9 | 120 |
| 2 | FIN ENTRAPPING | ○ | 7.5 | 1.2 | 160 |
| 3 | OUTER PADDLE | △ | 6.2 | 1.1 | 170 |
| 4 | NOTCH | × | 5.7 | 1.1 | 140 |

TRANSPORT MEMBER AND DEVELOPING DEVICE INCLUDING THE SAME

Japanese Patent Application No. 2016-211299 filed on Oct. 28, 2016, including description, claims, drawings, and abstract the entire disclosure is incorporated herein by reference in its entirety.

BACKGROUND

Technological Field

The present invention relates to a transport member and a developing device including the transport member. More specifically, the present invention relates to a transport member that transports a developer by rotating in a predetermined rotation direction around a rotation axis, and a developing device including the transport member.

Description of the Related art

An electrophotographic image forming apparatus includes a facsimile machine, a copying machine, a printer, and a multifunction peripheral (MFP) having a scanner function, a facsimile function, a copying function, a function as a printer, a data communication function, and a server function, and the like.

An image forming apparatus generally forms a toner image by developing an electrostatic latent image formed on an image carrier with a developing device, transfers this toner image to a paper, and then forms an image on the paper by fixing the toner image onto the paper with a fixing device. In addition, some image forming apparatuses develop an electrostatic latent image on a surface of a photoreceptor by a developing device to form a toner image, transfer the toner image to an intermediate transfer belt by using a primary transfer roller, and secondary transfer the toner image on the intermediate transfer belt onto a paper by using a secondary transfer roller.

The developing device includes a replenishing portion, a developing tank, a stirring/transport member, a supply member, a developer carrier, and a regulating member. The developer replenished into the developing tank by the replenishing portion is stirred and transported by the stirring/transport member in the developing tank, and is supplied onto the developer carrier through the supply member. An excessive amount of the developer supplied onto the developer carrier is scraped off by the blade-like regulating member, and a transport amount is made uniform in a gap between the regulating member and the developer carrier. The uniformed developer is supplied from the developer carrier to the image carrier.

In a two-component electrophotographic method, the developer contains toner and carrier. The toner forms an image on a paper, and the carrier serves to carry the toner.

Conventional developing devices are disclosed in, for example, JP 2005-352042 A and JP 2016-099378 A. JP 2005-352042 A discloses a developing device including a stirring screw having a plurally wound blade fixed on an inner diameter side of a plurality of axially extending fins.

JP 2016-099378 A discloses a developing device including a screw configured by a rotating shaft, a blade that transports toner, and a stirring paddle. This developing device further includes a relief passage of an opening in order to lower a pressure generated in the blade and the paddle during operation, to avoid aggregation.

In recent years, as a size and weight of an image forming apparatus have been reduced, a size of a developing device is also reduced, and an amount of a developer filled in the developing device is also reduced. A developer stirring/transport member is provided with a screw to efficiently transport the developer, and a paddle is often provided on the screw in order to uniformly mix the developer.

However, in the prior art, it has been difficult to efficiently mix and transport the developer having a low toner/carrier ratio (hereinafter also referred to as a T/C ratio) returned from a developing roller to the stirring/transport member.

In the technology disclosed in JP 2005-352042 A, since the fins are provided on an outer periphery of the screw, an area of the screw is reduced. This lowers a transport velocity of the developer, taking time to replace the developer in the developing device. Further, immediately below the developing roller, the developer having a low T/C ratio returned from the developing roller may possibly rotate together with the blade, and be caught again by the developing roller. This may cause image defect, particularly in forming a solid image or the like.

In the technology of JP 2016-099378 A, while a stirring capacity of the developer is slightly improved since the opening is provided on the screw, a transport velocity of the developer is slowed down, taking time to replace the developer in the developing device.

SUMMARY

To solve the above problems, it is an object of the present invention to provide a transport member capable of improving stirring performance of a developer, and a developing device including the transport member.

To achieve the abovementioned object, according to an aspect of the present invention, there is provided a transport member for transporting a developer by rotating in a rotation direction that is predetermined around a rotation axis, and the transport member reflecting one aspect of the present invention comprises: a shaft part including the rotation axis; and a blade part spirally provided on an outer peripheral surface of the shaft part, wherein the blade part includes a transport surface that is a surface facing a downstream side in a transport direction of the developer along the rotation axis, and a non-transport surface that is a surface other than the transport surface, and the transport member further comprises a fin protruding from the non-transport surface of the blade part, the fin being provided with an interval from the outer peripheral surface of the shaft part.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention:

FIG. 7 is a table showing a simulation result of a moving velocity of a developer in each direction of a developing screw;

DETAILED DESCRIPTION OF EMBODIMENTS

Hereinafter, one or more embodiments of the present invention will be described with reference to the drawings. However, the scope of the invention is not limited to the disclosed embodiments.

In the following embodiment, a case where a developing device is mounted in an image forming apparatus will be described. The image forming apparatus mounted with the developing device may be an MFP, a facsimile machine, a copying machine, a printer, or the like.

[Configuration of Image Forming Apparatus]

First, a configuration of the image forming apparatus according to this embodiment will be described.

Figure 1:
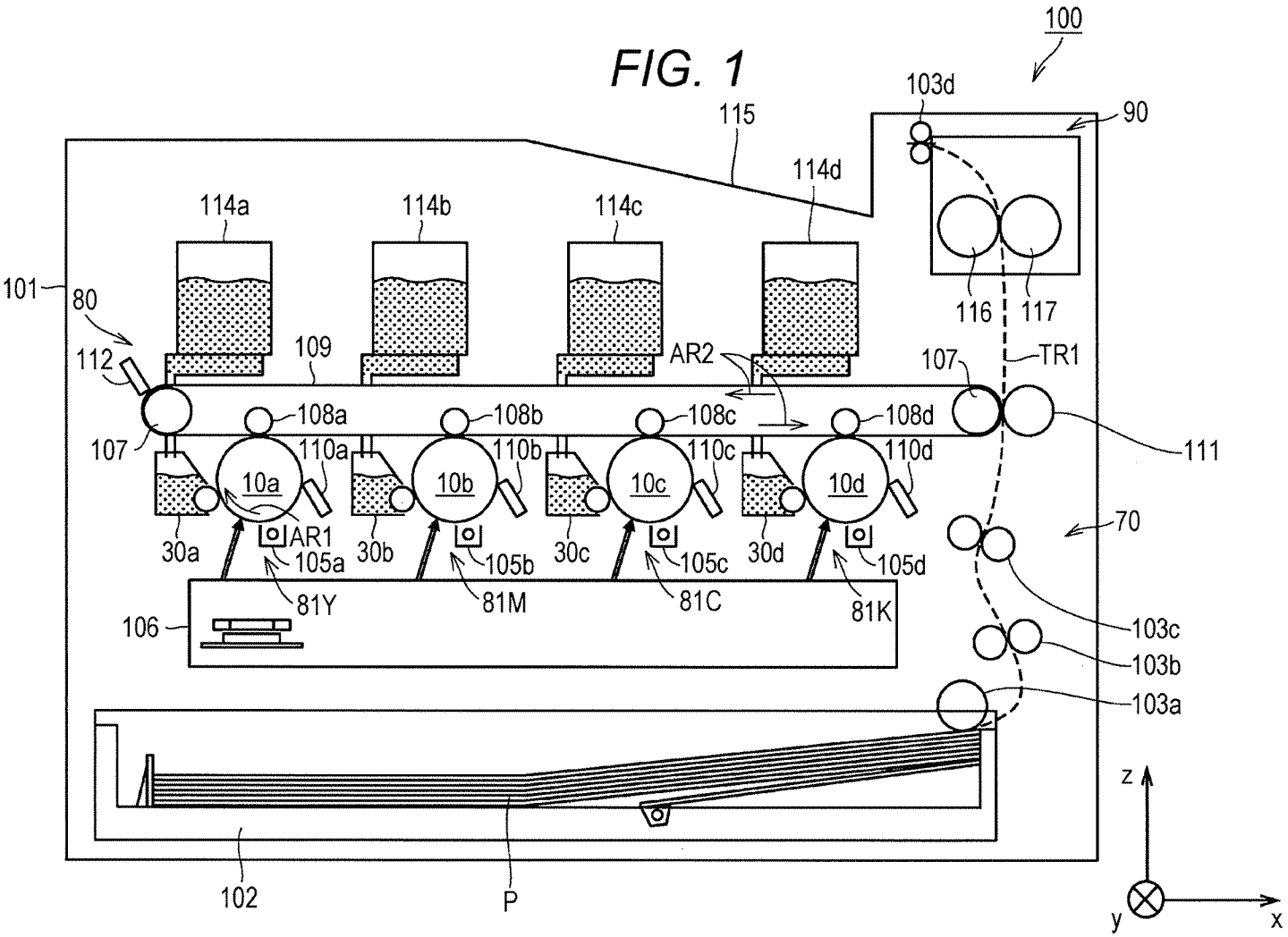
FIG. 1 is a cross-sectional view showing a configuration of an image forming apparatus according to an embodiment of the present invention.

FIG. 1 is a cross-sectional view showing a configuration of an image forming apparatus 100 according to an embodiment of the present invention.

Referring to FIG. 1, the image forming apparatus 100 in this embodiment is an MFP, and mainly includes a paper transport part 70, a toner image forming part 80, and a fixing device 90.

The paper transport part 70 includes a paper feeding tray 102, a paper feeding roller 103*a*, transport rollers 103*b* and 103*c*, a paper discharging roller 103*d*, and a paper discharging tray 115. The paper feeding tray 102 accommodates a paper P to be formed with an image. There may be a plurality of paper feeding trays 102. The paper feeding roller 103*a* is provided between the paper feeding tray 102 and a transport route TR1. The transport rollers 103*b* and 103*c* each are provided along the transport route TR1. The paper discharging roller 103*d* is provided on the most downstream side in the transport route TR1. The paper discharging tray 115 is provided at a top of an image forming apparatus body 101.

The toner image forming part 80 composes an image of four colors of yellow (Y), magenta (M), cyan (C), and black (K) in a so-called tandem system, and transfers the toner image to a paper. The toner image forming part 80 includes four sets of image forming units 81Y, 81M, 81C, and 81K, an exposure device (laser unit) 106, an intermediate transfer belt 109, primary transfer rollers 108*a*, 108*b*, 108*c*, and 108*d*, a secondary transfer roller 111, a cleaning device 112, and the like.

The individual image forming units 81Y, 81M, 81C, and 81K are juxtaposed immediately below the intermediate transfer belt 109. The image forming unit 81Y includes a photosensitive drum 10*a*, a charging roller 105*a*, a developing device 30*a*, a cleaning device 110*a*, and the like. The photosensitive drum 10*a* is rotationally driven in a direction indicated by an arrow AR1 in FIG. 1. The charging roller 105*a*, the developing device 30*a*, and the cleaning device 110*a* are disposed around the photosensitive drum 10*a*.

The image forming unit 81M includes a photosensitive drum 10*b*, a charging roller 105*b*, a developing device 30*b*, a cleaning device 110*b*, and the like. The image forming unit 81C includes a photosensitive drum 10*c*, a charging roller 105*c*, a developing device 30*c*, a cleaning device 110*c*, and the like. The image forming unit 81K includes a photosensitive drum 10*d*, a charging roller 105*d*, a developing device 30*d*, a cleaning device 110*d*, and the like. Each of the image forming units 81M, 81C, and 81K has a similar configuration as that of the image forming unit 81Y.

The exposure device 106, is provided below the image forming units 81Y, 81M, 81C, and 81K. The intermediate transfer belt 109 is provided above the image forming units 81Y, 81M, 81C, and 81K. The intermediate transfer belt 109 is annular, and is stretched between rotating rollers 107. The intermediate transfer belt 109 is rotationally driven in a direction indicated by an arrow AR2 in FIG. 1. The individual primary transfer rollers 108*a*, 108*b*, 108*c*, and 108*d* face the respective photosensitive drums 10*a*, 10*b*, 10*c*, and 10*d* with the intermediate transfer belt 109 interposed. The secondary transfer roller 111 is in contact with the intermediate transfer belt 109 in the transport route TR1. An interval between the secondary transfer roller 111 and the intermediate transfer belt 109 can be adjusted by a pressure contacting/separating mechanism (not shown). The cleaning device 112 is provided near the intermediate transfer belt 109.

The fixing device 90 includes a heating roller 116 and a pressure roller 117. The fixing device 90 fixes a toner image to a paper by holding and transporting the paper that carries the toner image along the transport route TR1, with a nip portion between the heating roller 116 and the pressure roller 117.

The image forming apparatus 100 rotates the photosensitive drum 10*a* to charge a surface of the photosensitive drum 10*a* by the charging roller 105*a*. The image forming apparatus 100 exposes the charged surface of the photosensitive drum 10*a* by the exposure device 106 in accordance with image formation information, and forms an electrostatic latent image on the surface of the photosensitive drum 10*a* in accordance with the image formation information.

Next, the image forming apparatus 100 supplies toner from the developing device 30*a* to the photosensitive drum 10*a* formed with the electrostatic latent image to develop, and forms a toner image of Y color on the surface of the photosensitive drum 10*a*.

The image forming apparatus 100 forms toner images of respective M, C, and K colors on the respective surfaces of the photosensitive drums 10*b*, 10*c*, and 10*d* in the similar manner.

Next, the image forming apparatus 100 uses each of the primary transfer rollers 108*a*, 108*b*, 108*c*, and 108*d* to sequentially transfer the toner images of respective colors formed on the photosensitive drums 10*a*, 10*b*, 10*c*, and 10*d* onto a surface of the intermediate transfer belt 109 (primary transfer). The surface of the intermediate transfer belt 109 is formed with a toner image composed by toner images of the respective colors.

The image forming apparatus 100 removes toner remaining on the individual photosensitive drums 10*a*, 10*b*, 10*c*, and 10*d* without been transferred to the intermediate transfer belt 109, by the cleaning devices 110*a*, 110*b*, 110*c*, and 110*d*, respectively.

Subsequently, the image forming apparatus 100 transports the toner image formed on the surface of the intermediate transfer belt 109 to a position facing the secondary transfer roller 111, by the rotating rollers 107.

On the other hand, the image forming apparatus 100 feeds the paper P accommodated in the paper feeding tray 102 by the paper feeding roller 103*a*, and guides the paper P between the intermediate transfer belt 109 and the secondary transfer roller 111 along the transport route TR1, by the transport rollers 103*b* and 103*c* (timing roller). Then, the image forming apparatus 100 transfers the toner image formed on the surface of the intermediate transfer belt 109 to the paper P by the secondary transfer roller 111.

The image forming apparatus 100 removes and collects the toner remaining on the surface of the intermediate transfer belt 109 without being transferred to the paper P, by the cleaning device 112.

The image forming apparatus 100 guides the paper P having the transferred toner image to the fixing device 90, and fixes the toner image onto the paper P by the fixing device 90. Thereafter, the image forming apparatus 100 discharges the paper P having the fixed toner image to the paper discharging tray 115 by the paper discharging roller 103*d*.

When an amount of each toner inside the developing devices 30*a*, 30*b*, 30*c*, and 30*d* is decreased due to image formation, each toner stored inside toner bottles 114*a*, 114*b*, 114*c*, and 114*d* of the respective Y, M, C, and K colors is transferred to the respective developing devices 30*a*, 30*b*, 30*c*, and 30*d*. Each of the toner bottles 114*a*, 114*b*, 114*c*, and 114*d* is detachable, and when toner in any one of the toner bottles 114*a*, 114*b*, 114*c*, and 114*d* runs out, a user replaces the toner bottle. This enables continuous supply of the toner to the image forming apparatus 100.

Hereinafter, each of the photoreceptor and the developing device in any image forming unit among the image forming units 81Y, 81M, 81C, and 81K may be referred to as a photosensitive drum 10 (an example of an image carrier) and a developing device 30.

[Configuration of Developing Device]

Next, a configuration of the developing device in this embodiment will be described.

Figure 2:
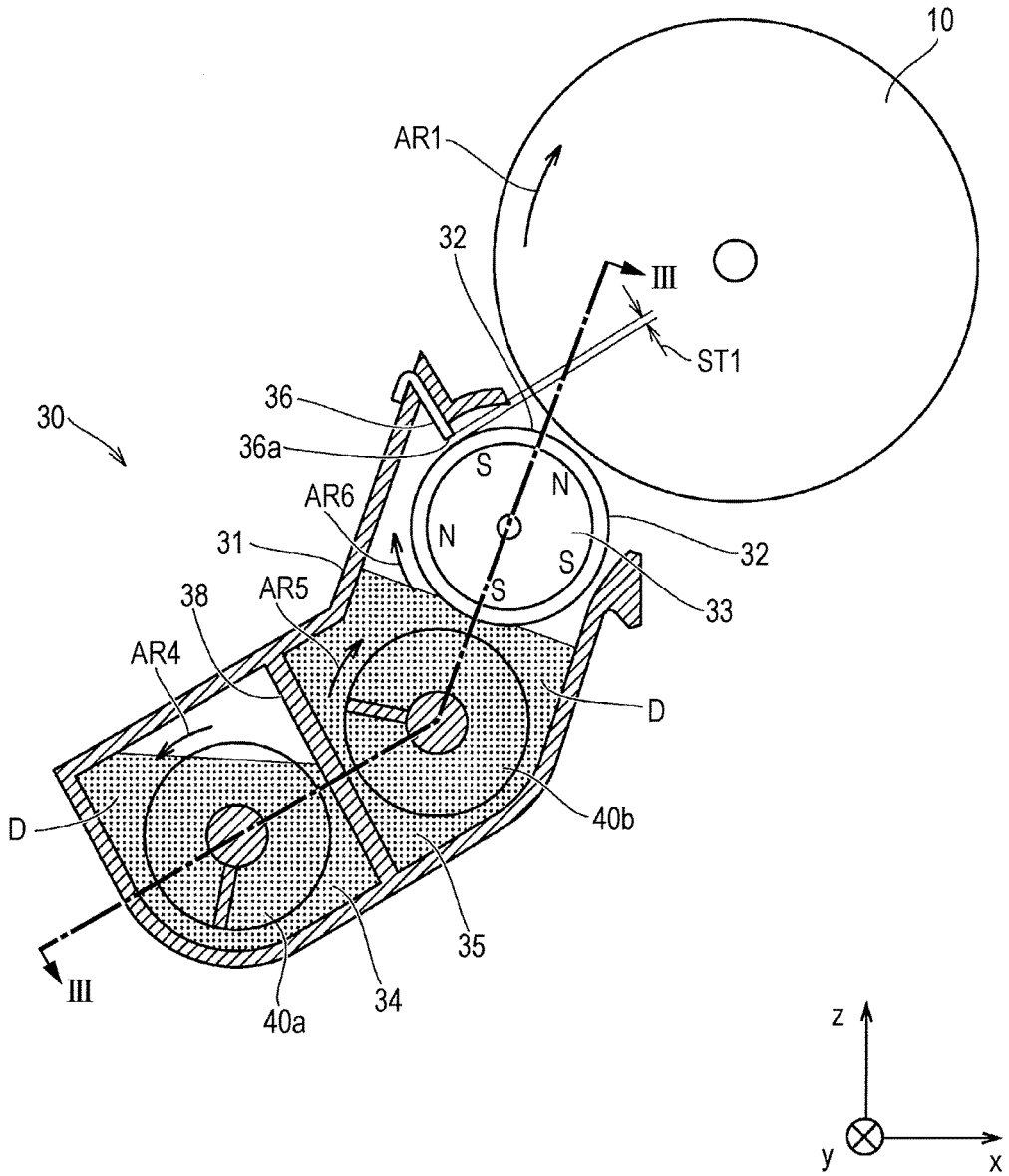
FIG. 2 is a cross-sectional view showing a configuration of a developing device according to an embodiment of the present invention.
Figure 3:
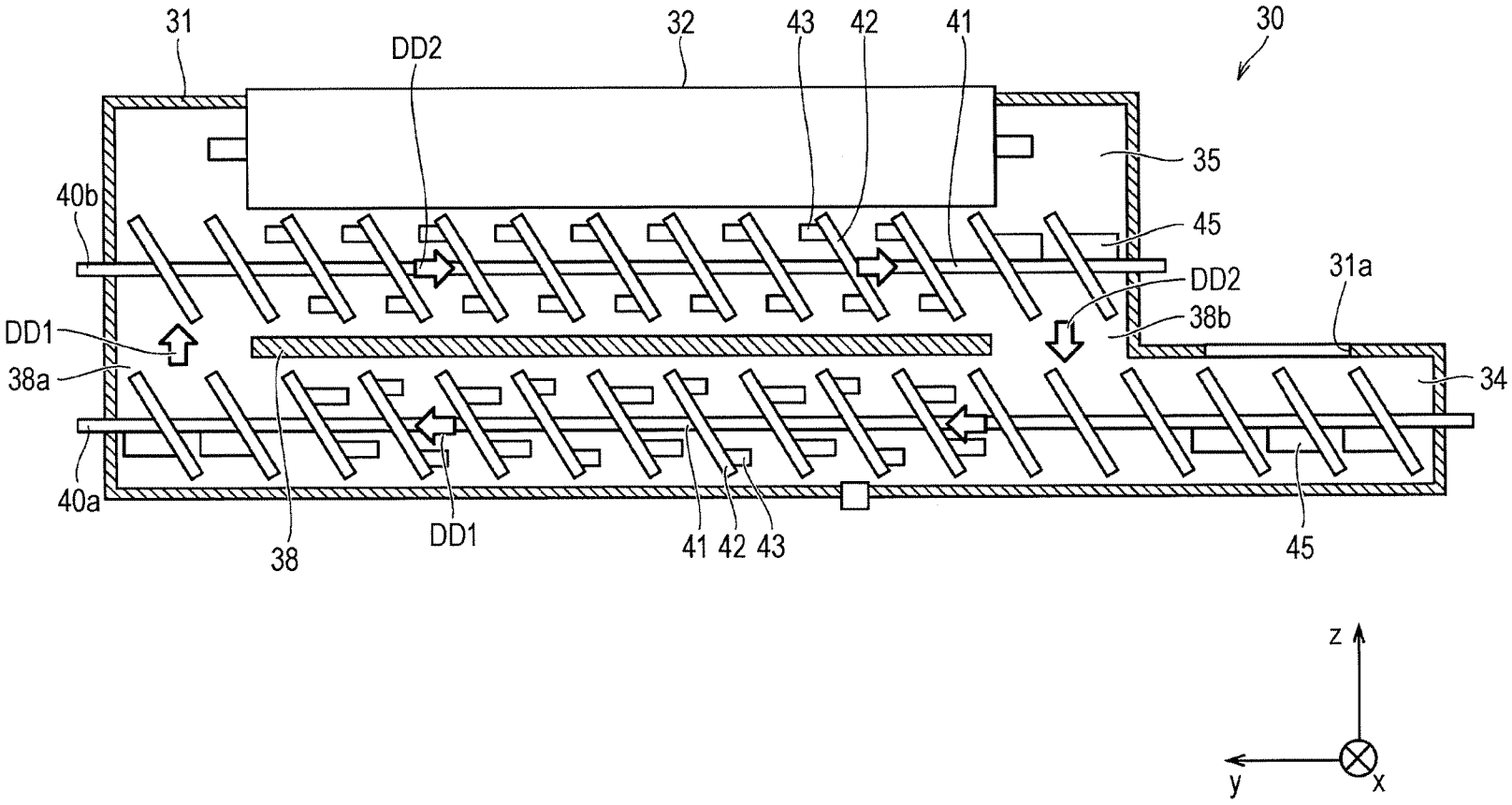
FIG. 3 is a cross-sectional view taken along line III-III of FIG. 2.

FIG. 2 is a cross-sectional view showing a configuration of the developing device 30 according to an embodiment of the present invention. FIG. 3 is a cross-sectional view taken along line of FIG. 2.

Referring to FIGS. 2 and 3, the developing device 30 includes a housing 31, a developing roller 32, a regulating member 36, a partition 38, a stirring screw 40*a*, and a developing screw 40*b* (an example of a transport member).

Inside the housing 31, a developer D containing a magnetic material is accommodated. The developer D contains a magnetic carrier and toner.

The inside of the housing 31 is partitioned into a transport path 34 and a transport path 35, by the partition 38. Each of the transport paths 34 and 35 and the partition 38 extends in a direction along a rotation axis of the developing roller 32. The transport path 35 is provided closer to the developing roller 32 than the transport path 34. Rotation axes of the photosensitive drum 10, the developing roller 32, the stirring screw 40*a*, and the developing screw 40*b* are parallel to each other. Near a right end portion of the housing 31 in FIG. 3, there is provided a charging port 31*a* to introduce the developer into inside the housing 31.

The stirring screw 40*a* is disposed in the transport path 34. The stirring screw 40*a* rotates in a direction indicated by an arrow AR4, thereby to stir the developer D and transport the developer D in a direction indicated by an arrow DD1. This causes the toner in the developer D to be frictionally charged. On the most downstream side on the partition 38 in the direction indicated by the arrow DD1, an opening 38*a* is provided. The developer D in the transport path 35 is drawn up to the transport path 35 through the opening 38*a*. The stirring screw 40*a* extends in a right direction in FIG. 3 further than the developing screw 40*b*, and a part of the stirring screw 40*a* extending in the right direction in FIG. 3 faces the charging port 31*a*.

The developing screw 40*b* is disposed in the transport path 35. The developing screw 40*b* rotates in a direction indicated by an arrow AR5, thereby to transport the developer D supplied from the transport path 34 in a direction indicated by an arrow DD2. When being transported by the developing screw 40*b*, the developer D is supplied to the developing roller 32. On the most downstream side on the partition in the direction indicated by the arrow DD2, an opening 38*b* is provided. The developer remaining without being supplied to the developing roller 32 is drawn down from the transport path 35 to the transport path 34 through the opening 38*b*.

The developing roller 32 develops an electrostatic latent image formed on the surface of the photosensitive drum 10 by using the developer D. The developing roller 32 faces the photosensitive drum 10 with a predetermined interval therebetween. The developing roller 32 is rotationally driven in a direction indicated by an arrow AR6. The developing roller 32 includes a magnet member 33 on an inner peripheral side thereof. The magnet member 33 is alternately magnetized to an N pole and an S pole along a circumferential direction. The developing roller 32 captures and holds the developer D transported by the developing screw 40*b* on an outer peripheral surface of the developing roller 32, by a magnetic force of the magnet member 33.

The regulating member 36 has a plate-like shape, and is fixed to the housing 31 near the developing roller 32. An end part 36*a* of the regulating member 36 is disposed to face the outer peripheral surface of the developing roller 32 via a required interval ST1 at a position facing the S pole of the magnet member 33. The regulating member 36 regulates an amount of the developer D transported by the developing roller 32.

Then, the developing roller 32 supplies the toner contained in the developer D located in a developing area, to the surface of the photosensitive drum 10. The developer D is supplied to the surface of the photosensitive drum 10 by a potential difference between a developing bias and a surface potential of the photosensitive drum 10. This causes development of the electrostatic latent image formed on the surface of the photosensitive drum 10 by the toner, and formation the toner image on the surface of the photosensitive drum 10.

Each of the stirring screw 40*a* and the developing screw 40*b* serves to supply the developer D to the developing roller 32, and serves to restore a T/C ratio of the developer D by stirring the developer D having a low T/C ratio returned from the developing roller 32. Further, for smooth replacement of the developer D, and a constant T/C ratio of the developer D inside the developing device 30, a transport velocity of the developer D by the stirring screw 40*a* and the developing screw 40*b* is desirably higher.

[Configuration of Transport Member]

Next, a configuration of a transport member in this embodiment will be described. In this embodiment, the transport member is used as at least either of the stirring screw 40*a* and the developing screw 40*b*.

Figure 4:
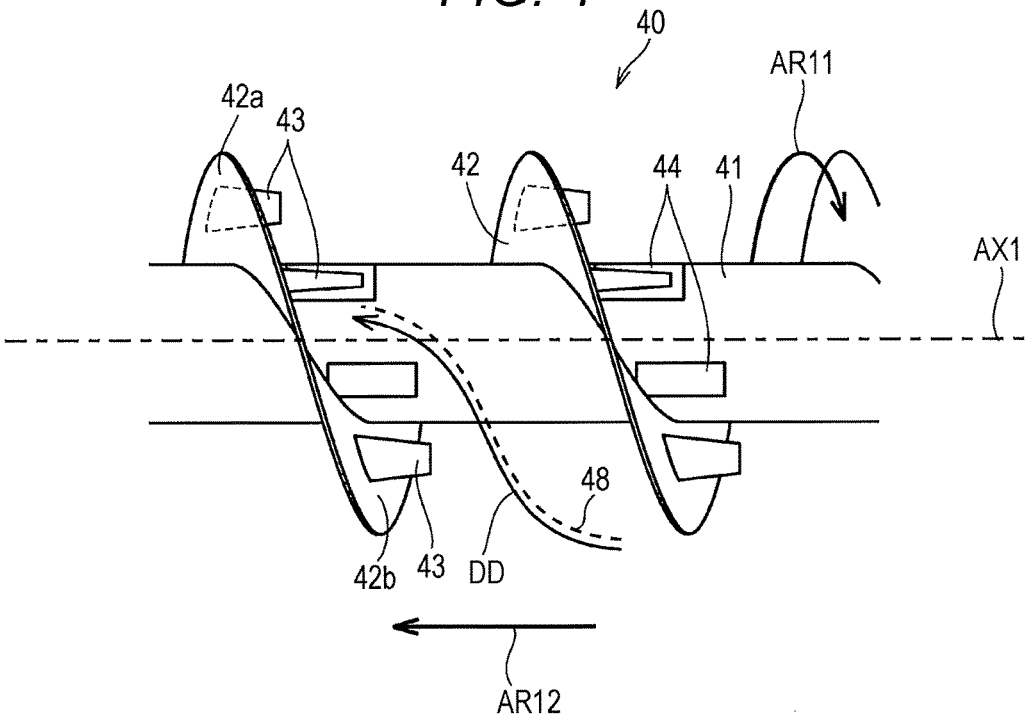
FIG. 4 is a side view showing a configuration of a transport member according to an embodiment of the present invention.
Figure 5:
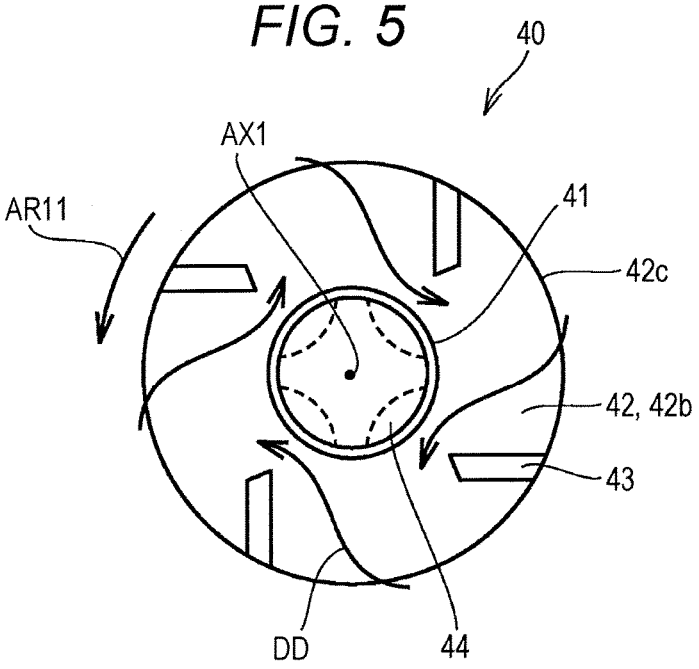
FIG. 5 is a view showing a configuration of a transport member according to an embodiment of the present invention, as viewed from an upstream side in a transport direction indicated by an arrow AR12 in FIG. 4.

FIGS. 4 and 5 are views showing a configuration of the transport member 40 according to an embodiment of the present invention. FIG. 4 is a side view, and FIG. 5 is a view as viewed from the upstream side in the transport direction indicated by the arrow AR12 in FIG. 4.

Referring to FIGS. 4 and 5, the transport member 40 transports the developer mainly in the transport direction indicated by the arrow AR12, by rotating in the rotation direction indicated by an arrow AR11 around a rotation axis AX1. The transport direction indicated by the arrow AR12 is a direction along the rotation axis AX1. The transport member 40 includes a shaft part 41, a blade part 42, and a fin 43.

The shaft part 41 includes the rotation axis AX1. The shaft part 41 includes a recess 44 provided on an outer peripheral surface thereof. Here, a plurality of recesses 44 are provided, and there are four recesses 44 equally over one round around the rotation axis AX1 when viewed in FIG. 5. The recess 44 may be omitted.

The blade part 42 is spirally provided on the outer peripheral surface of the shaft part 41. The blade part 42 includes a front surface 42*a* (an example of a transport surface) facing a downstream side (left side in FIG. 4) in the transport direction indicated by the arrow AR12, and a rear surface 42*b* (an example of a non-transport surface) facing the upstream side (right side in FIG. 4) in the transport direction indicated by the arrow AR12. When the transport member 40 rotates, the developer moves in the transport direction indicated by the arrow AR12, by a force received from the front surface 42*a*.

Here, a plurality of fins 43 are provided. The plurality of fins 43 protrude from the rear surface 42*b* of the blade part 42, and protrude, for example, toward the upstream side in the transport direction indicated by the arrow AR12. The fins 43 are provided with an interval from the outer peripheral surface of the shaft part 41, and are provided, for example, at an end part 42*c* on an outer diameter side (a side away from the rotation axis AX1) in the blade part 42.

As the plurality of fins 43, when viewed in FIG. 5, there are four of the fins 43 over one round around the rotation axis AX1. When viewed in FIG. 5, the plurality of fins 43 are desirably arranged equally around the rotation axis AX1.

It is sufficient that the fins 43 protrude from the non-transport surface that is a surface other than the front surface 42*a* of the blade part 42, and the fins 43 may protrude from an end surface on the outer diameter side in the blade part 42.

The outer peripheral surface of the shaft part 41, the front surface 42*a* of the blade part 42, and the fins 43 form a flow path 48 through which the developer flows. That is, the developer flows in a direction indicated by an arrow DD along the flow path 48 as a local flow. When viewed in FIG. 5, the direction indicated by the arrow DD is a direction from a radially outer side toward a radially inner side of the rotation axis AX1 in the blade part 42, and is a direction from a downstream side to an upstream side in a rotation direction (the direction indicated by the arrow AR11) of the transport member 40.

[Effect of Embodiment]

Next, effects of this embodiment will be described.

Referring to FIGS. 3 to 5, the developer having a low T/C ratio returned from the developing roller 32 to the transport path 34 or 35 is mostly located on an outer diameter side of the stirring screw 40*a* or the developing screw 40*b*. The developer located on the outer diameter side of the stirring screw 40*a* or the developing screw 40*b* is in a state being peeled off from the stirring screw 40*a* or the developing screw 40*b*, and the developer is difficult to be taken into and stirred in the stirring screw 40*a* or the developing screw 40*b*. As a result, the developer having a low T/C ratio tends to stay on the outer diameter side of the stirring screw 40*a* and the developing screw 40*b*.

According to the transport member 40 of this embodiment, the fins 43 can take the developer located on an outer side than the transport member 40 (the side farther from the shaft part 41 than the end part 42*c* on the outer diameter side of the blade part 42), to an inner side of the transport member 40 (the side close to the shaft part 41). This enables rapid recovery of the T/C ratio of the developer returned from the developing roller 32, and improvement of stirring performance of the transport member 40. Further, it is possible to sufficiently charge the developer located on an outer side of the transport member 40, achieving improvement of image defects.

In addition, since it is unnecessary to provide the fins 43 on the front surface 42*a* of the blade part 42 serving as the transport surface for the developer, it is possible to ensure an area of the transport surface for the developer and maintain a transport velocity of the developer.

Moreover, providing the flow path 48 allows the developer to be transported to the outer peripheral surface of the shaft part 41, enabling supply of the developer to the developing roller 32 with the developer sufficiently stirred.

Further, arranging the fins 43 at equal intervals around the rotation axis AX1 can ensure stable rotation of the transport member 40.

Figure 6C:
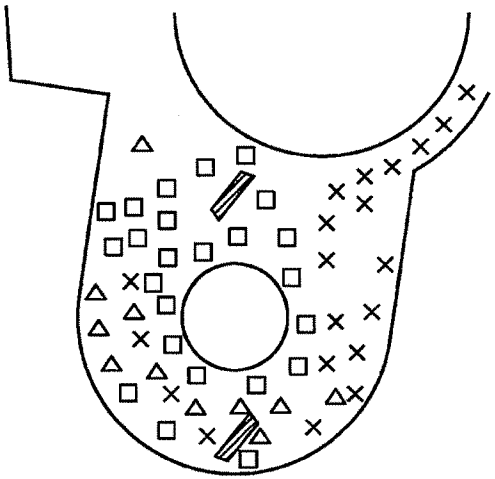
FIGS. 6A to 6C are views showing a simulation result showing distribution of a charge amount and a T/C ratio of a developer inside a developing device.
Figure 6B:
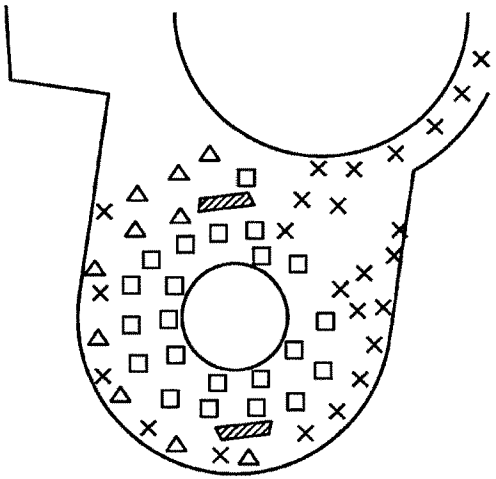
Figure 6A:
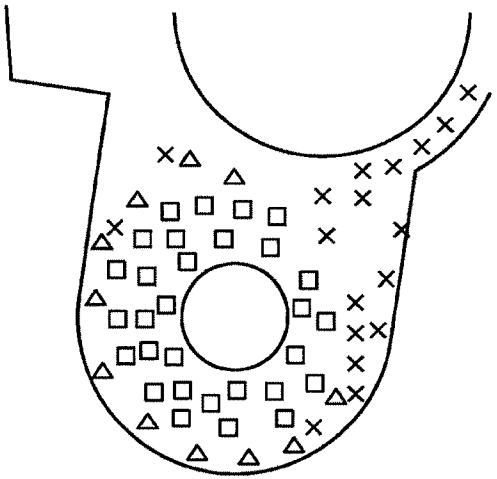

FIGS. 6A to 6C are views showing a simulation result showing distribution of a charge amount and a T/C ratio of the developer inside the developing device.

Referring to FIGS. 6A to 6C, the developer is indicated by a square, a triangle, or a cross in accordance with the charge amount and the T/C ratio. The square is a developer sufficiently charged and having a high T/C ratio. The cross is a developer insufficiently charged and having a low T/C ratio, immediately after supply of the toner to the developing roller. The triangle is a developer moderately charged and having a moderate T/C ratio.

FIG. 6A is a simulation result of a normal developing screw without a fin and rotating paddle. In the normal screw, since the developer is not stirred much, the sufficiently charged developer stays near the rotation axis, and the insufficiently charged developer stays on an outer side of the developing screw. In this configuration, when the sufficiently charged developer alone is transported to the developing roller, and the insufficiently charged developer is infrequently transported to the developing roller, image defects may occur.

FIG. 6B is a simulation result of a developing screw including a rotating paddle. In the developing screw including the rotating paddle, while stirring performance is improved as compared with the normal screw, the sufficiently charged developer still stays near the rotation axis. This is presumably because the developer around the rotating paddle alone is stirred.

FIG. 6C is a simulation result of the transport member 40 in this embodiment. In the transport member 40, stirring performance is greatly improved as compared with the normal screw. In addition, the developer having a low T/C ratio and the developer having a moderate T/C ratio enter near the rotation axis. Further, there are many of the developers having a high T/C ratio on the outer side of the transport member 40. In this configuration, the sufficiently charged developer is supplied to the developing roller, enabling image formation with stable image quality.

Figure 8A:
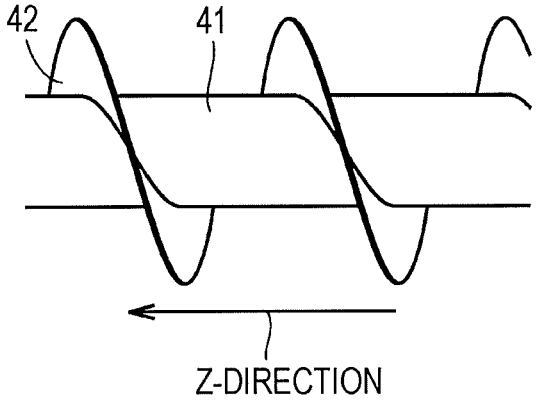
FIGS. 8A and 8B are views for explaining Z-direction, 0-direction, and R-direction in the simulation result of FIG. 7.
Figure 8B:
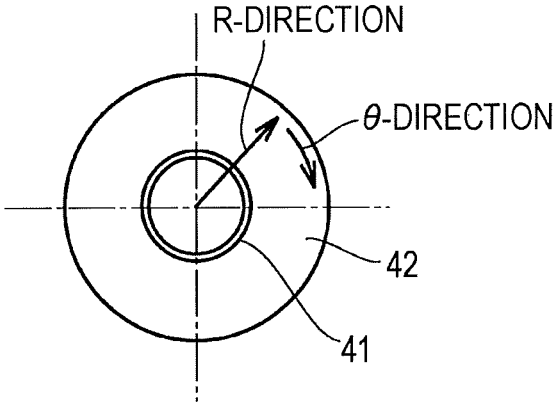

FIG. 7 is a table showing a simulation result of a moving velocity of the developer in each direction of the developing screw. FIGS. 8A and 8B are views for explaining Z-direction, θ-direction, and R-direction in the simulation result of FIG. 7. FIG. 8A is a view of the developing screw as viewed from a direction orthogonal to the rotation axis. FIG. 8B is a view of the developing screw as viewed from a direction of the rotation axis.

Referring to FIGS. 7, 8A, and 8B, Sample 1 (comparative example) is a simulation result of a normal developing screw without a fin and rotating paddle. Sample 2 (example of the present invention) is a simulation result of the transport member 40 in this embodiment. Sample 3 (comparative example) is a simulation result of a screw (screw with an outer paddle) described in JP 2005-352042 A. Sample 4 (comparative example) is a simulation result of a screw (screw with a notch) described in JP 2016-099378 A. A velocity VZ is a moving velocity of the developer in Z-direction, which is a direction along the rotation axis. A velocity VR is a moving velocity of the developer in R-direction, which is a radial direction with respect to the rotation axis. A velocity Vθ is a moving velocity of the developer in θ-direction, which is a circumferential direction with respect to the rotation axis.

In Sample 2, while the velocity VZ is maintained at a high value, the velocities VR and Vθ are high. As a result, it is presumed that stirring performance can be improved without lowering a transport velocity of the developer in Sample 2.

On the other hand, in Sample 1, it is presumed that the velocities VR and Vθ are low and stirring performance is low. In Sample 3, although the velocity Vθ is high, the velocity VZ is low and the value of the velocity VR is moderate. In Sample 4, the velocities VZ and Vθ are low, and the value of the velocity VR is moderate. As a result, in Samples 3 and 4, it is presumed that although a transport velocity of the developer is low and stirring performance is favorable to some extent, replacement of the developer inside the developing device is insufficient.

[Concrete Example of Fins]

A number and shape of the fin in the transport member are optional. Next, a concrete example of the fin in the transport member will be described.

Figures 9A, 9B, 9C:
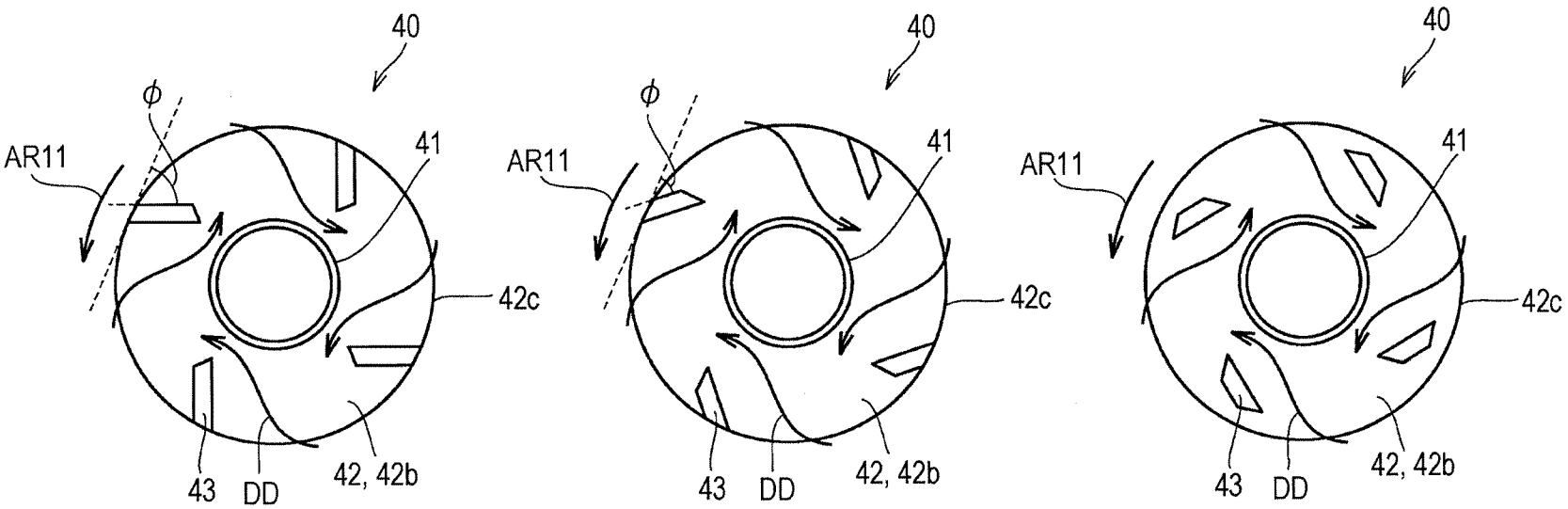
FIGS. 9A to 9C are first views showing a concrete example of a shape of a fin according to an embodiment of the present invention, as viewed from the upstream side in the transport direction indicated by the arrow AR12 in FIG. 4.

FIGS. 9A to 9C are first views showing a concrete example of the fin 43 according to an embodiment of the present invention, as viewed from the upstream side in the transport direction indicated by the arrow AR12 in FIG. 4.

Referring to FIGS. 9A to 9C, when viewed from the upstream side in the transport direction indicated by the arrow AR12 (FIG. 4), an angle formed by a tangential line of an outer shape of the blade part 42 and an extending direction of the fin 43 is defined as an angle φ. FIG. 9A shows a case where the angle φ is 60 degrees. FIG. 9B shows a case where the angle φ is 45 degrees.

The angle φ is set based on a diameter of the blade part 42 and a mounting position, and set in consideration of flowability of the developer, stirring performance of the transport member 40, and the like. As an example, when the transport member 40 has a small diameter, a length of the fin 43 is about ½ of a length of the blade part 42, and the developer easily flows through the flow path 48, the angle φ is desirably set to 45 degrees. When the transport member 40 has a large diameter, the angle φ may continuously change from an outer diameter side to an inner diameter side of the fin 43. In this case, the angle φ on the outer diameter side of the fin 43 may be 60 degrees, and the angle φ on the inner diameter side of the fin 43 may be 30 degrees.

In addition to a case where the fin 43 is provided at the end part 42*c* on the outer diameter side of the blade part 42 as shown in FIGS. 9A and 9B, the fin 43 may be provided between the end part 42*c* of the blade part 42 and the shaft part 41 as shown in FIG. 9C.

Figure 10A:
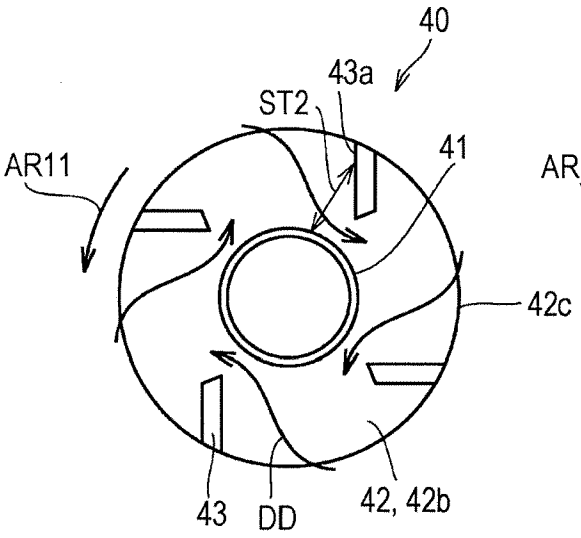
FIGS. 10A to 10C are second views showing a concrete example of a shape of a fin according to an embodiment of the present invention, as viewed from the upstream side in the transport direction indicated by the arrow AR12 in FIG. 4.

FIGS. 10A to IOC are second views showing a concrete example of the fin 43 according to an embodiment of the present invention, as viewed from the upstream side in the transport direction indicated by the arrow AR12 in FIG. 4.

Figure 10B:
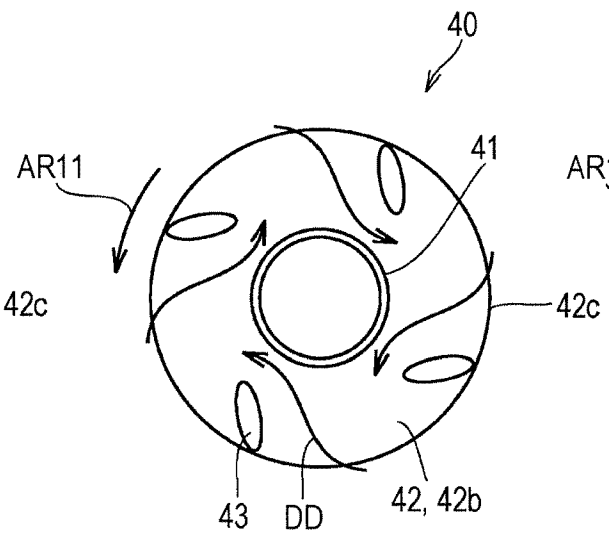
Figure 10C:
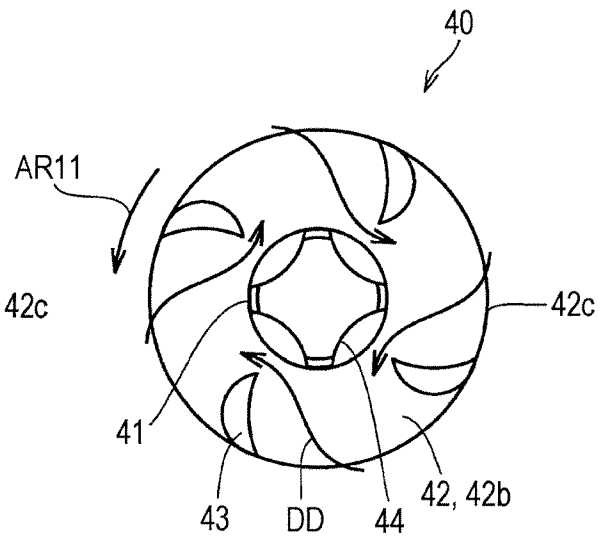

Referring to FIGS. 10A to 10C, the shape of the fin 43 is set in consideration of a rotation speed (of the blade part 42) of the transport member 40, flowability of the developer, and the like. The fin 43 includes a guide surface 43*a*, which is a surface facing the rotation direction of the transport member 40 indicated by the arrow AR11. When viewed from the upstream side in the transport direction indicated by the arrow AR12 (FIG. 4), a distance ST2 between the outer peripheral surface of the shaft part 41 and the guide surface 43*a* of the fin 43 is desirably decreased from the downstream side toward the upstream side in the rotation direction indicated by the arrow AR11 (decreased from an upstream side toward a downstream side in a flow direction of the developer, indicated by the arrow DD). The outer shape of the fin 43 is optional, which may be a rectangular shape as shown in FIG. 10A, an elliptical shape as shown in FIG. 10B, or a crescent shape as shown in FIG. 10C. In particular, when the outer shape of the fin 43 is a crescent shape as shown in FIG. 10C, the recess 44 is desirably formed on the outer peripheral surface of the shaft part 41. This can relieve pressure applied from the shaft part 41 to the developer introduced into the inner side of the transport member 40.

Figure 11:
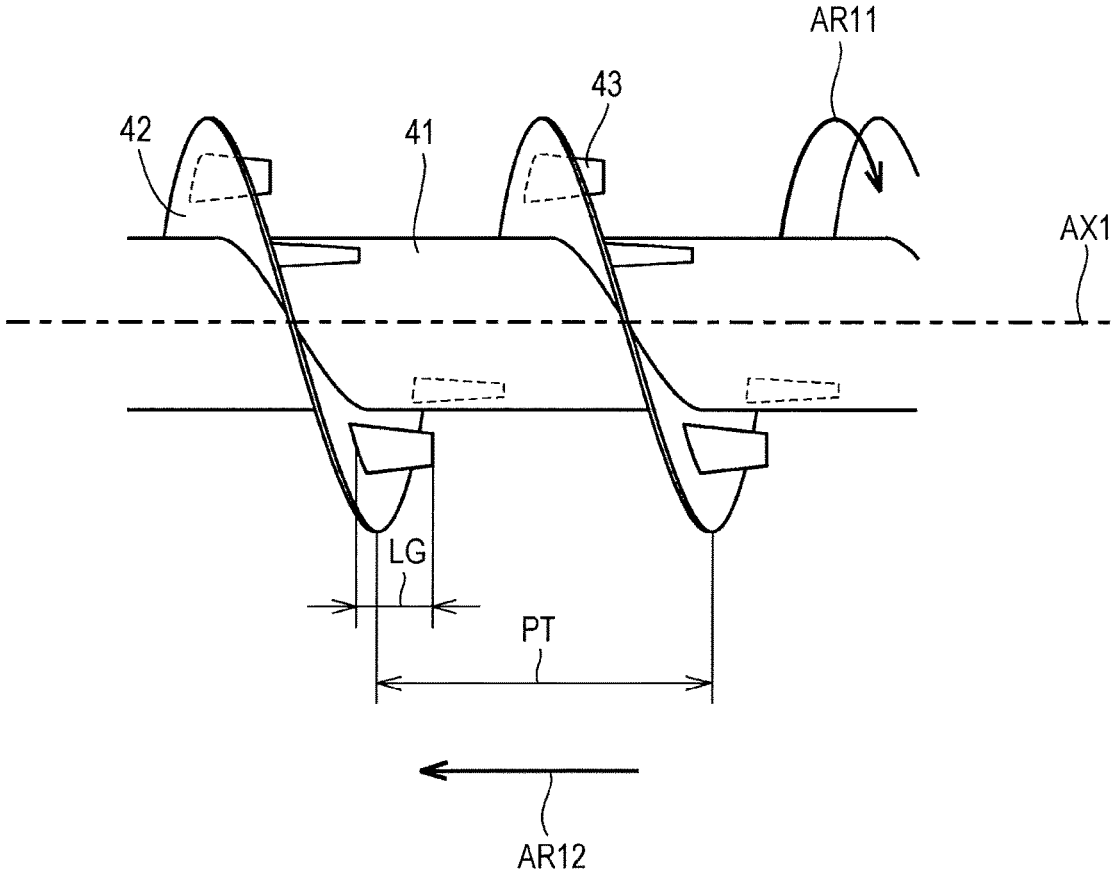
FIG. 11 is a side view schematically showing a relationship between a length L and a pitch PT of a fin in an embodiment of the present invention.

FIG. 11 is a side view schematically showing a relationship between a length L and a pitch PT of the fin 43 in an embodiment of the present invention.

Referring to FIG. 11, each length L of the fins 43 along the rotation axis AX1 is smaller than the pitch PT (interval) between the fins 43 along the rotation axis AX1. This can avoid contact of the fins 43 with the blade parts 42 located on the upstream side of the fins 43 in the transport direction indicated by the arrow AR12, and can keep a high transport velocity of the developer.

In particular, when the number of the plurality of fins 43 located over one round around the rotation axis AX1 in the blade part 42 is n (here, n=4), and a size of the pitch PT of the plurality of fins 43 along the rotation axis AX1 is d, each length L of the plurality of fins 43 along the rotation axis AX1 is desirably a length defined by L=d/n. This allows the entire pitch PT to be stirred by the fins 43 when the transport member 40 rotates once, allowing the developer to be guided to the inner diameter side of the transport member 40 without excess or deficiency.

[Application Example of Transport Member to Developing Device]

When the transport member 40 in this embodiment is used for both the stirring screw 40*a* and the developing screw 40*b*, each of the stirring screw 40*a* and the developing screw 40*b* may be applied to the developing device 30 as follows.

Referring to FIG. 3, in the developing screw 40*b* provided in the transport path 35, the fins 43 are provided on the blade part 42 excluding both end parts in a rotation axis direction (portions facing the opening 38*a* or 38*b*). This enables entrapping and guiding of the developer having a low T/C ratio peeled off from the developing roller 32, to the inner side of the developing screw 40*b* (the direction toward the shaft part 21). On the other hand, in the developing screw 40*b*, no fin is provided on the blade part 42 (receiving part) facing the opening 38*a*. In the developing screw 40*b*, no fin is provided on the blade part 42 (sending-out part) facing the opening 38*b*, but there is provided a plate-like paddle 45 to send out the developer to the transport path 34.

The stirring screw 40*a* provided in the transport path 34 is provided with the fin 43 on the blade part 42 excluding both end parts in the rotation axis direction (a portion facing the opening 38*a*, the opening 38*b*, or the charging port 31*a*). This can realize an optimum stirring state, and enables uniform stirring. On the other hand, in the stirring screw 40*a*, no fin is provided on the blade part 42 (sending-out part) facing the opening 38*a*, on the blade part 42 (sending-out part) facing the opening 38*b*, and on the blade part 42 facing the charging port 31*a*. In the stirring screw 40*a*, a plate-like paddle 45 is provided on the blade part 42 (sending-out part) facing the opening 38*a*, and on the blade part 42 facing the charging port 31*a*.

When the transport member 40 according to this embodiment is used for both the stirring screw 40*a* and the developing screw 40*b*, the fin 43 of the stirring screw 40*a* and the fin 43 of the developing screw 40*b* may be different from each other in at least either of a number and a length along the rotation axis. In particular, by setting the length L of the fin 43 of the developing screw 40*b* to a standard length to secure stirring performance and a replacement speed of the developer, and setting the length L of the fin 43 of the stirring screw 40*a* longer than the length L of the fin of the developing screw 40*b*, stirring performance of the stirring screw 40*a* may be further enhanced.

Additionally, while the transport member 40 is used as the developing screw 40*b*, the shaft part 41 provided with the blade part 42 and paddle 45 alone may be used without the transport member 40 used as the stirring screw 40*a*.

[Others]

In the present invention, in addition to the above-described embodiments, the image forming apparatus mounted with the developing device may be a full-color image forming apparatus that forms a full color image by rotating a rotary developing device holding a plurality of developing devices to sequentially guide the individual developing devices to a photosensitive drum, or an image forming apparatus that forms monochrome image, or the like.

It is to be understood that the above-described embodiment and examples are not restrictive, but are illustrative in all respects. The scope of the present invention is defined not by the description above but by the claims, and it is intended to include all modifications within the meaning and scope equivalent to the claims.

Although embodiments and examples of the present invention have been described and illustrated in detail, it is clearly understood that the same is by way of illustration and example only and not limitation, the scope of the present invention should be interpreted by terms of the appended claims. The scope of the present invention is intended to include all modifications within the meaning and scope equivalent to the claims.

What is claimed is:

1. A transport member that transports a developer by rotating in a rotation direction that is predetermined around a rotation axis, the transport member comprising:

a shaft part including the rotation axis; and a blade part spirally provided on an outer peripheral surface of the shaft part, wherein the blade part includes a transport surface that is a surface facing a downstream side in a transport direction of the developer along the rotation axis, and a non-transport surface that is a surface other than the transport surface, and the transport member further comprises a fin protruding from the non-transport surface of the blade part, wherein a space is provided between the fin and the outer peripheral surface of the shaft part and a second space is provided between the fin and the transport surface.

2. The transport member according to claim 1, wherein the non-transport surface protruded with the fin is a surface facing an upstream side in the transport direction, and the fin protrudes toward the upstream side in the transport direction of the developer along the rotation axis.

3. The transport member according to claim 1, wherein the outer peripheral surface of the shaft part, the transport surface of the blade part, and the fin form a flow path through which the developer flows.

4. The transport member according to claim 3, wherein the flow path is formed along a direction from a radially outer side toward a radially inner side of the rotation axis in the blade part when viewed from the upstream side in the transport direction, and the direction is from a downstream side to an upstream side in the rotation direction of the transport member.

5. The transport member according to claim 1, wherein an angle formed by a tangential line of an outer shape of the blade part and an extending direction of the fin is 45 degrees when viewed from an upstream side in the transport direction.

6. The transport member according to claim 1, wherein the fin includes a guide surface that is a surface facing the rotation direction of the transport member, and a distance between the outer peripheral surface of the shaft part and the guide surface of the fin is decreased from an upstream side toward a downstream side in a developer flowing direction when the blade part is viewed from an upstream side in the transport direction.

7. The transport member according to claim 1, wherein the shaft part includes a recess provided on the outer peripheral surface.

8. The transport member according to claim 1, wherein there are a plurality of the fins, and each length of the plurality of the fins along the rotation axis is smaller than an interval between the plurality of the fins along the rotation axis.

9. The transport member according to claim 8 wherein, when the number of the plurality of the fins located in one round around the rotation axis in the blade part is n, and the interval between the plurality of the fins along the rotation axis is d, each length L of the plurality of the fins is a length defined by L=d/n.

10. The transport member according to claim 8, wherein the plurality of the fins are uniformly arranged around the rotation axis when the blade part is viewed from an upstream side in the transport direction.

11. A developing device comprising:

a developing roller that develops an electrostatic latent image formed on a surface of an image carrier by using a developer;

a housing that accommodates the developer; and a partition that partitions an interior of the housing into first and second transport paths, wherein the second transport path is provided closer to the developing roller than the first transport path, and a transport member includes a first transport member that is the transport member according to claim 1, and transports the developer to the developing roller in the first transport path, and a second transport member that is the transport member according to claim 1, and transports the developer in the second transport path.

12. The developing device according to claim 11, wherein the fin of the first transport member and the fin of the second transport member are different from each other in at least either of a number and a length along the rotation axis.

13. The developing device according to claim 12, wherein a length of the fin of the first transport member along the rotation axis is longer than a length of the fin of the second transport member along the rotation axis.

* * * * *